US006637248B2

(12) United States Patent
Ishii et al.

(10) Patent No.: US 6,637,248 B2
(45) Date of Patent: Oct. 28, 2003

(54) METHOD FOR MACHINING PROTUBERANCE OF SPECIAL-SHAPED TUBE

(75) Inventors: Akira Ishii, Nitta-machi (JP); Akihiro Endo, Ohta (JP)

(73) Assignee: Sakamoto Industry Co., Ltd. (JP)

( * ) Notice: Subject to any disclaimer, the term of this patent is extended or adjusted under 35 U.S.C. 154(b) by 1 day.

(21) Appl. No.: 10/002,548

(22) Filed: Nov. 15, 2001

(65) Prior Publication Data

US 2002/0139162 A1 Oct. 3, 2002

(30) Foreign Application Priority Data

Mar. 28, 2001 (JP) ..... 2001-092469
Jun. 29, 2001 (JP) ..... 2001-198784

(51) Int. Cl.[7] ..... B21D 3/02

(52) U.S. Cl. ..... 72/121; 72/112; 72/370.23; 72/191; 29/890

(58) Field of Search ..... 72/121, 125, 126, 72/112, 84, 78, 370.23, 370.26, 191; 29/890, 890.08

(56) References Cited

U.S. PATENT DOCUMENTS 5,331,834 A * 7/1994 Yoshida ..... 72/191
6,467,322 B2 * 10/2002 Nogami et al. ..... 72/121

FOREIGN PATENT DOCUMENTS

JP 03-226327 10/1991

* cited by examiner

*Primary Examiner*—Allen Ostrager
*Assistant Examiner*—John S Goetz
(74) *Attorney, Agent, or Firm*—Eugene Stephens & Associates

(57) ABSTRACT

A revolution center line (C) of a roll (R) is made eccentric with respect to an axis (L) of an elliptic tube (1). The eccentric amount $\epsilon$ is set such that when the revolution radius of the roll (R) is gradually reduced from a state in which the roll (R) is not in contact with any part of the elliptic tube (1), the roll (R) contacts one (4) of the two protuberances (4, 4) which is located on the opposite side to the eccentric direction generally earlier than any other part of the eccentric tube (1). The roll (R) is revolved and reciprocally moved in a direction of the revolution center line (C). At least at one end portion of the reciprocal movement, the roll (R) is moved towards the revolution center line (C) side. By repeating this procedure, the roll (R) is press contacted with the first-mentioned protuberance (4) so as to crush it for elimination.

7 Claims, 6 Drawing Sheets

(A)

(B)

(A)

(B)

METHOD FOR MACHINING PROTUBERANCE OF SPECIAL-SHAPED TUBE

BACKGROUND OF THE INVENTION

This invention relates to a machining method for reducing an amount of projection of one of two protuberances (the expression "reducing an amount of projection of a protuberance(s)" used herein includes not only a concept of diminishing an amount of projection but also a concept of eliminating the protuberance(s)) by spinning, which protuberances are formed on intersection parts, in a short axis, between a flattened tube stock part of a sectional configuration having a short axis and a long axis and a reduced-diameter part of a circular sectional configuration which is formed at one end portion of the tube stock part by spinning.

Heretofore, an elliptic tube (special-shaped tube) having an elliptic configuration in section has been widely used for a catalyst converter and a premuffler of automotive vehicles. The reasons are as follows. Comparing the elliptic tube with the circular tube having a circular configuration in section, if the sectional areas of them are same, the length of the elliptic tube in short axis direction is shorter than the diameter of the circular tube. Therefore, in the case where the catalyst converter, etc. are loaded under the floor (i.e., chassis) of a vehicle, the elliptic tube has such an advantage that by loading the catalyst converter, etc. such that the short axis direction of the elliptic tube is oriented to an up and down direction, the distance from a ground surface to the elliptic tube can be increased.

Incidentally, an exhaust tube is connected to opposite end portions of the catalyst converter and the premuffler. The exhaust tube normally has a circular configuration in section. So, as shown in FIG. 8, reduced diameter portions 2 each comprising a tapered section 2*a* and a straight tube section 2*b* are formed on opposite end portions of the elliptic tube 1 which constitutes the catalyst converter and the premuffler, and the exhaust tube is connected to the straight tube section 2*b*.

In general, the reduced diameter portion 2 is, as shown in FIG. 9, formed by spinning. Spinning against the reduced diameter portion 2 is executed by press contacting a roller (forming tool) R with the end portion of the elliptic tube 1 while revolving the roller R about an axis L of the elliptic tube 1. While revolving the roller R, the roller R is moved from a center side of the elliptic tube 1 to the end portion side so that the revolution radius of the roller R is reduced. By this, the tapered section 2*a* is formed. Thereafter, while keeping the revolution radius of the roller R fixed, the roller R is moved to an end face of a tube stock part 3, thereby forming the straight tube section 2*b* (see Japanese Patent Application Laid-Open No. H03-226327).

In the elliptic tube 1, the outer periphery of the tube stock part 3 which is not yet subjected to spinning is, as shown in FIG. 10, preferably smoothly continuous with the outer periphery of the tapered section 2*a* of the reduced diameter portion 2 which is already subjected to spinning. However, if the reduced diameter portion 2 is subjected to spinning, protuberances 4 are, as shown in FIGS. 8(A) to 8(C), formed on two intersection parts in the short axis direction of all the intersection portions between the outer peripheral portion of the tube stock part 3 and the outer peripheral portion of the diameter reduced portion 2. The reason is that the spinning executed by the roller R starts from the outer peripheral portion of the tube stock part 3 in the long axis direction and therefore, as indicated by arrows of FIG. 9, the metal composition of a portion forming the long axis side of the tube stock part 3 is brought closer towards the short axis side as the roller R revolves. As a result, the protuberance 4 is formed. The formation of the protuberance 4 brings about such a problem that the protuberance 4 interferes with other members at the time of mounting the catalyst or premuffler in which the elliptic tube 1 is used on a vehicle. In case of the converter, for example, the protuberance 4 interferes with the heat insulation cover. Therefore, it is demanded to develop a machining method for either eliminating the protuberance 4 or diminishing the amount of projection thereof.

SUMMARY OF THE INVENTION

The present invention has been accomplished in order to meet with the above-mentioned demand. According to the present invention, there is provided a machining method for reducing, by spinning, an amount of projection of one of two protuberances of a special shaped tube including a flattened tube stock part of a sectional configuration having a short axis and a long axis and a reduced-diameter part of a circular sectional configuration which is formed at one end portion of the tube stock part by spinning which is executed by revolving a forming tool with respect to the tube stock part, the two protuberances being formed on two intersection parts between an outer peripheral portion in the short axis direction of the tube stock part and an outer peripheral portion of the reduced diameter part and projecting outward in the short axis direction, a revolution center line of the forming tool for the spinning with respect to the special shaped tube being made eccentric towards the other of the two protuberances from a center between the two protuberances, and the forming tool being press contacted with only the one of the two protuberances located on the opposite side to the eccentric direction so as to spin only the one of the two protuberances.

It is preferred that an eccentric amount from the center between the two protuberances to the revolution center line of the forming tool is set such that when a revolution radius of the forming tool is gradually reduced from a state in which the forming tool is not in contact with any part of the elliptic tube, the forming tool contacts said one protuberance generally first.

The forming tool is preferably moved in a direction of the revolution center line and particularly preferably reciprocally moved in a direction of the revolution center line plural times. In the case where the forming tool is reciprocally moved plural times, it is preferred that the forming tool is moved by only a predetermined distance towards the revolution center line side so that the revolution radius is reduced at least at one end portion in a direction of the reciprocal movements.

BRIEF DESCRIPTION OF THE DRAWINGS

FIG. 1(A) is a front view showing a state in which a roll begins to execute spinning with respect to a protuberance and FIG. 1(B) is a view when viewed in a direction as indicated by an arrow B of FIG. 1(A).

FIG. 1(A) is a front view showing a state in which the spinning executed with respect to the protuberance is almost finished and FIG. 2(B) is a view when viewed in a direction as indicated by an arrow B of FIG. 2(A).

FIG. 8(A) is a front view thereof, FIG. 8(B) is a plan view thereof and FIG. 8(C) is a side view thereof

DETAILED DESCRIPTION OF THE INVENTION

The present invention will now be described in the form of one preferred embodiment with reference to FIGS. 1 through 7.

Figure 1:
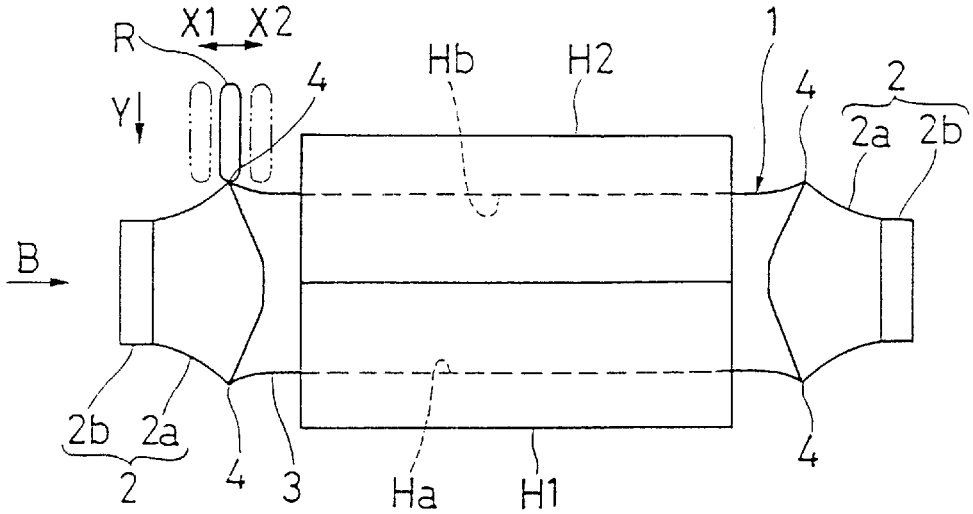
FIG. 1 is a view showing a general construction of a first embodiment of the present invention in which the present invention is applied to an elliptic tube as a first special shaped tube.
Figure 1:
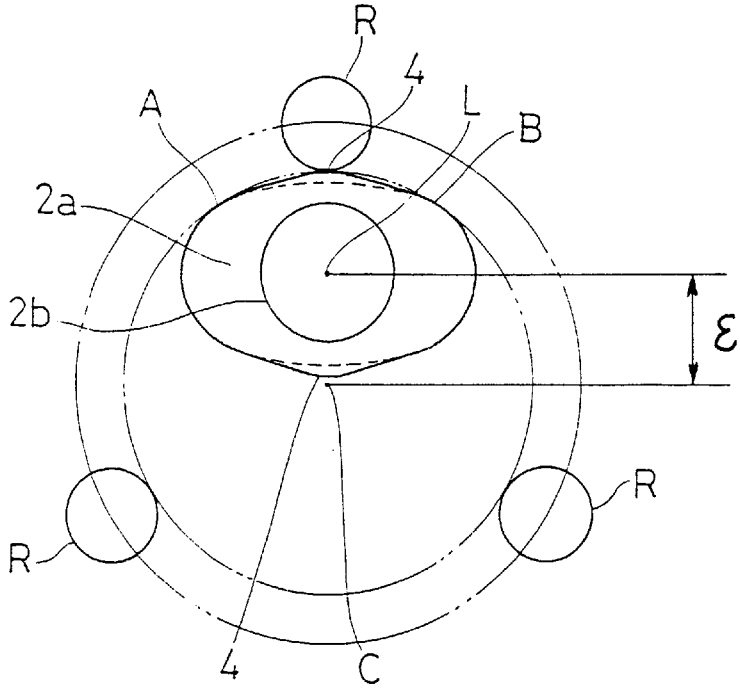
Figure 2:
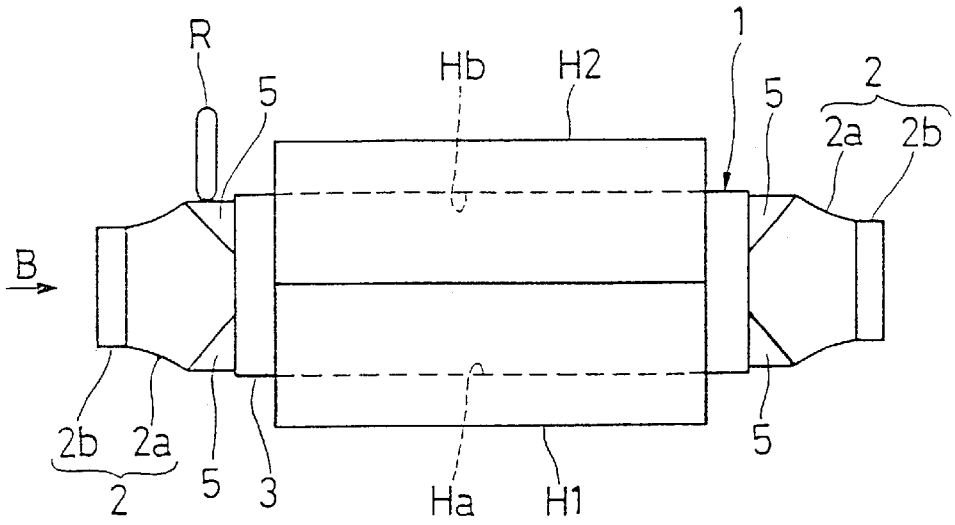
FIG. 2 is a view like FIG. 1.
Figure 2:
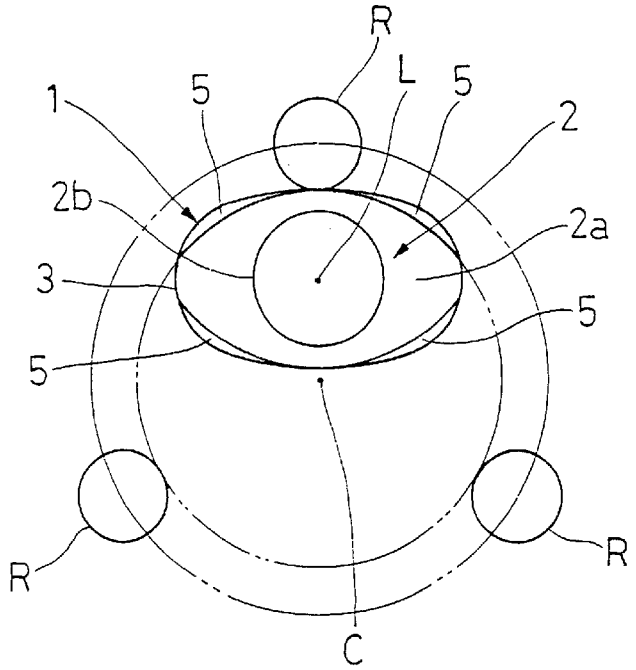
Figure 3:
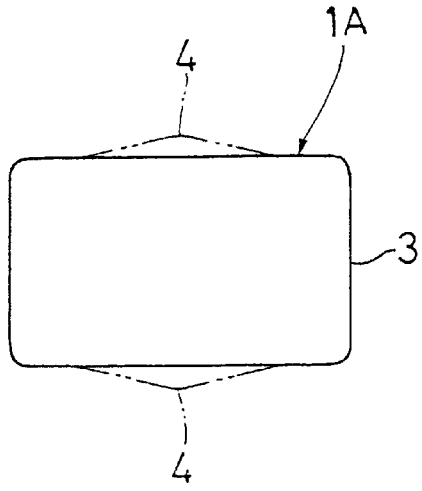
FIG. 3 is a view showing a sectional configuration of a second special shaped tube which can be employed in the present invention.
Figure 4:
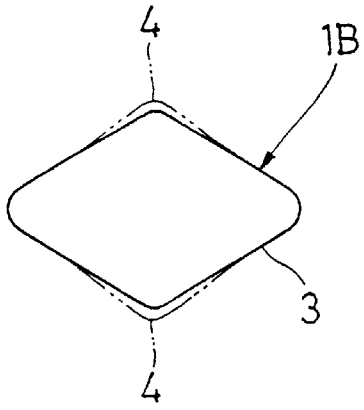
FIG. 4 is a view showing a sectional configuration of a third special shaped tube which can be employed in the present invention.
Figure 5:
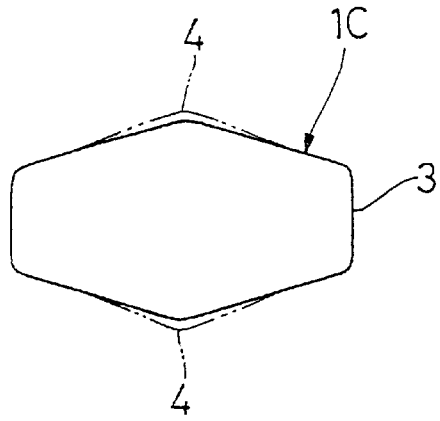
FIG. 5 is a view showing a sectional configuration of a fourth special shaped tube which can be employed in the present invention.
Figure 6:
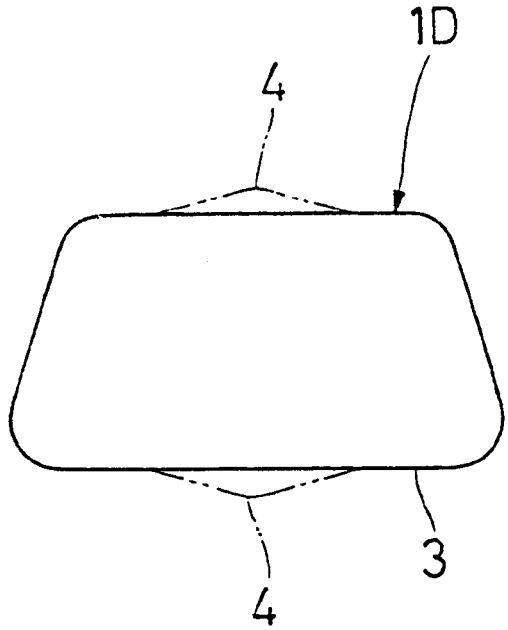
FIG. 6 is a view showing a sectional configuration of a fifth special shaped tube which can be employed in the present invention.
Figure 7:
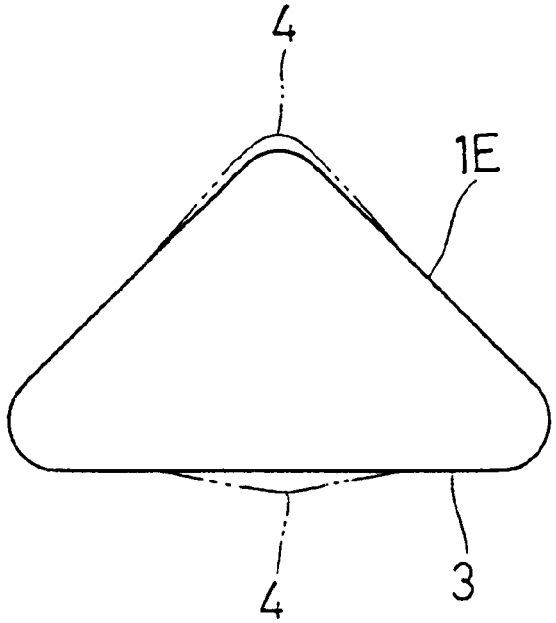
FIG. 7 is a view showing a sectional configuration of a seventh special shaped tube which can be employed in the present invention.
Figure 8:
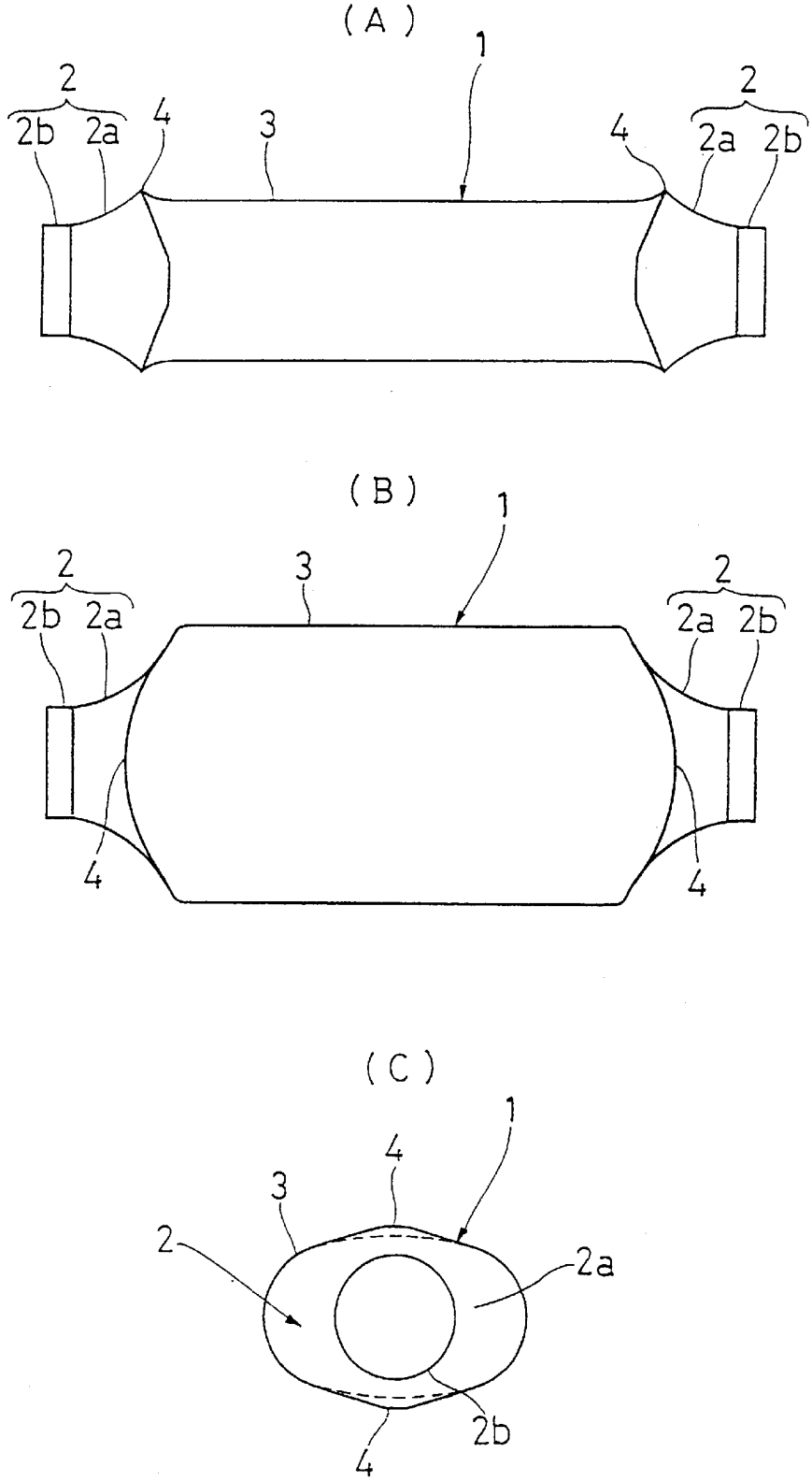
FIG. 8 is a view showing an elliptic tube with a reduced diameter portion formed on each end portion thereof by spinning.
Figure 9:
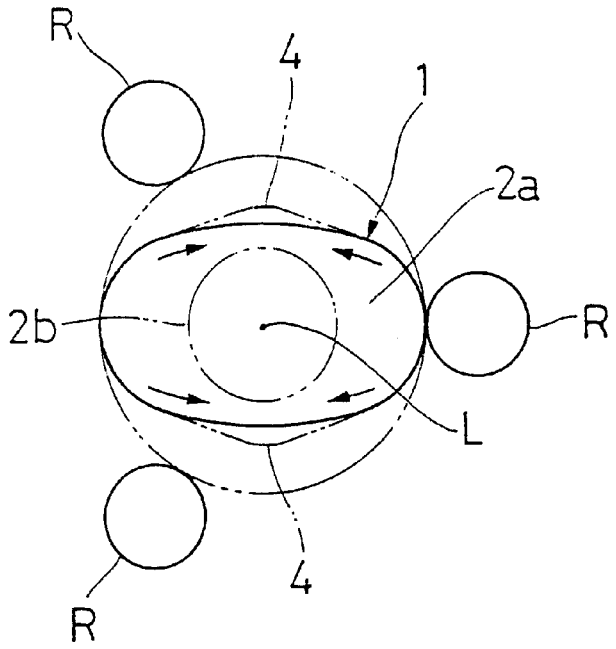
FIG. 9 is an explanatory view for explaining why the reduced diameter portions are formed on the elliptic tube by spinning.
Figure 10:
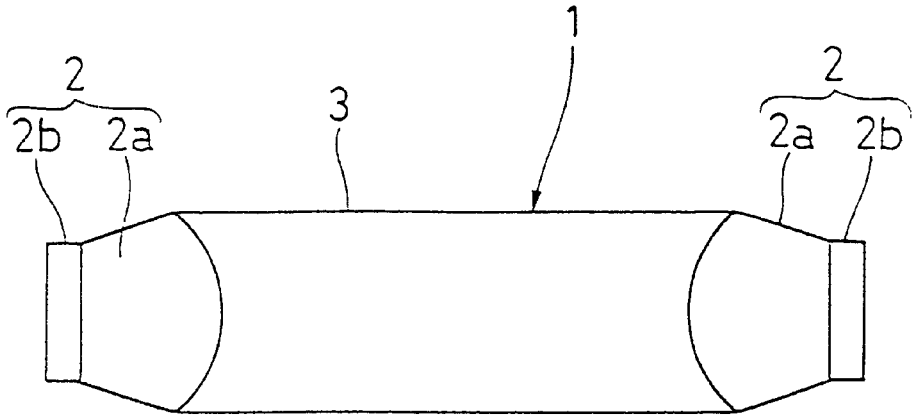
FIG. 10 is a front view showing an ideal elliptic tube having a reduced diameter portion at each end portion thereof.

FIGS. 1 and 2 are schematic views showing the principles of a machining method according to the present invention, which method is for either eliminating a protuberance 4 of an elliptic tube 1 or diminishing the amount of projection of the protuberance 4. FIG. 1 shows an initial state of the protuberance 4 at the time of starting the machining and FIG. 2 shows an end state in which machining of the protuberance 4 is almost finished.

At the time of executing the machining method of the present invention, an elliptic tube (special shaped tube) as a work is fixed as in the case of normal spinning. In this embodiment, the elliptic tube 1 is fixed by sandwichingly holding a tube stock part 3 from the top and bottom between one pair of holding members H1, H2 having holding recesses Ha, Hb which are generally same in radius of curvature as the tube stock part 3. The elliptic tube 1 may be fixed by other fixing means such as, for example, a fixing chuck.

Thereafter, the protuberance 4 is either eliminated or diminished in its amount of projection by spinning the protuberance 4 using a roll (forming tool) R. As for the roll R, only one may be used. However, it is preferable to use a plurality of rolls R in respect of machining efficiency. At the time of spinning the protuberance 4 using the roll R, first, as shown in FIG. 1(B), a revolution center line C of the roll R is made eccentric to one of the two protuberances 4, 4 side with respect towards an axis L of the elliptic tube 1. In the case of this embodiment, the revolution center line C is made eccentric towards the lower protuberance 4 from the axis L. That is, the revolution center line C is made eccentric downwards in a short axis with respect to the axis L of the elliptic tube 1. An eccentric amount $\epsilon$ between the axis L and the revolution center line C is preferably set such that when the revolution radius of the roll R is gradually reduced from a state in which the roll R is not in contact with any part of the elliptic tube 1, the roll R contacts the protuberance 4 located on the opposite side (upper side in FIG. 1(B)) to the eccentric direction earlier than any other part of the eccentric tube 1.

However, only if spinning to be executed with respect to a portion, for example, a portion A or B or its nearby area of FIG. 1(B), far away from the protuberance 4 in the circumferential direction does not affect adversely to the machining with respect to the protuberance 4, the roll R may contact the portion A or B or its nearby area at the same time or a little earlier than the roll R contacts the protuberance 4.

When the roll R is brought into contact with the protuberance 4, the roll R is revolved about the revolution center line C and reciprocally moved in the directions (the directions indicated by arrows X1, X2 of FIG. 1) of the revolution center line C. Actually, since the amount of projection of the protuberance 4 is different by respective elliptical tubes 1, it is preferable that the roll R is revolved and reciprocally moved before the roll R contacts the protuberance 4. When the roll R is brought to at least one end portion in the reciprocal movement, the roll R is slightly moved towards the revolution center line C (the direction indicated by an arrow Y of FIG. 1) side. By this, the revolution radius of the roll R is reduced. Of course, the roll R may be moved in the direction indicated by the arrow Y whenever the roll R is brought to each end portion during the reciprocal movement. The amount of movement of the roll R in the direction indicated by the arrow Y is preferably set to, for example, about ¼ the amount of projection of the protuberance 4. When the roll R is moved in the direction indicated by the arrow Y to reduce its revolution radius, the roll R is press contacted with the protuberance 4 to diminish (to crush the projection 4) the amount of projection of the protuberance 4. By repeating this procedure, the amount of projection is diminished or the projection 4 is eliminated as shown in FIG. 2. Instead, a semi-circular cylindrical portion 5 is formed on the tube stock part 3 and on the tapered section 2*a* in the vicinity of the protuberance 4. The semicircular cylindrical portion 5 is composed of an arcuate surface whose arc is drawn about the revolution center line C as its center of curvature and extended in circumferential directions of the elliptic tube 1 about the area where the protuberance 4 is formed. In this embodiment, although the semicircular cylindrical portion 5 is formed such that the intersection part between the outer peripheral surface of the semi-circular cylindrical portion 5 and the short axis of the tube stock part 3 is located slightly closer to the revolution center line C side than the intersection part between the outer peripheral surface of the tube stock part 3 and the short axis of the tube stock part 3, it may be formed such that the two intersection parts are located in a same position in the short axis direction.

After one of the two protuberances 4, 4 formed on one end portion of the elliptic tube 1 is either eliminated or diminished in its amount of projection in the manner as described above, the other protuberance 4 is either eliminated or diminished in its amount of projection. At that time, the sandwichingly held state of the elliptic tube 1 between the holding members H1 and H2 is released and the elliptic tube 1 is turned 180 degrees about the axis L. Then, the elliptic tube 1 is fixedly sandwichingly held between the holding members H1 and H2 again. It is also an interesting alternative that each roll R is moved upward relative to the elliptic tube 1 so that the revolution center line C of the roll R is shifted to a symmetrical position with respect to the axis L of the elliptic tube 1. Thereafter, the amount of projection of the other protuberance 4 (the lower protuberance 4 of FIG. 1) is either diminished or the protuberance 4 is eliminated. Of course, the two protuberances 4, 4 formed on the other end portion of the elliptic tube 1 can also be either diminished their amount of projection or eliminated in the same manner as described above.

It should be noted here that the present invention is not limited to the above-mentioned embodiment but that many modifications can be made in accordance with necessity.

For example, in the above embodiment, although the present invention is applied to an elliptic tube having an elliptic configuration in section, it may likewise be applied to many other special shaped flattened tubes in a sectional configuration having a short axis and a long axis. Specific examples thereof are shown in FIGS. 3 through 7. In the specific examples of FIGS. 3 through 7, the up and down direction is the short axis direction and the right and left direction (horizontal direction) is the long axis direction. A special shaped tube 1A of FIG. 3 has a rectangular configuration in section. A special shaped tube 1B of FIG. 4 has a diamond-like configuration in section. A special shaped tube IC of FIG. 5 has a flattened generally hexagonal configuration in section. A special shaped tube ID of FIG. 6 has a flattened trapezoidal configuration in section in which its height is rather low compared with its length in the right and left direction. A special shaped tube 1E of FIG. 7 has a triangular configuration in section in which its height is rather low compared with its length in the right and left direction.

In the above embodiment, although the roll R is reciprocally moved plural times, it may be reciprocally moved only once. Also, in case a roll R having a large width is employed, the amount of projection of the protuberance 4 can be diminished or the protuberance 4 can be eliminated in a state in which the roll R is positionally fixed in the directions of X1 and X2 without reciprocally moving the roll R. At that time, it suffices that the protuberance 4 is located at a widthwise central part of the roll R and the revolution radius of the roll R is gradually reduced while revolving the roll R.

What is claimed is:

1. A machining method for reducing, by spinning, an amount of projection of a first of two protuberances of a special shaped tube comprising steps of:

mounting a flattened tube stock part of a sectional configuration having a short axis and a long axis and a reduced-diameter part of a circular sectional configuration, said reduced-diameter part being formed at one end portion of said tube stock part by spinning which is executed by revolving a forming tool with respect to said tube stock part, and said two protuberances being formed on two intersection parts between an outer peripheral portion in the short axis direction of said tube stock part and an outer peripheral portion of said reduced diameter part, and projecting outward in the short axis direction;

mounting said forming tool for the spinning with respect to said special shaped tube about a revolution center line;

locating the revolution center line offset from a center between said two protuberances in an eccentric direction towards a second of said two protuberances; and press contacting said forming tool with only said first of said two protuberances located with respect to the center between said two protuberances in a direction opposite to the eccentric direction so as to spin only said first of said two protuberances.

2. The method according to claim 1, including an additional step of gradually reducing a revolution radius of said forming tool with respect to the revolution center line, and wherein the revolution center line is offset from the center between said two protuberances by an eccentric amount such that when the revolution radius of said forming tool is gradually reduced from a state in which said forming tool is not in contact with any part of said special shaped tube, said forming tool contacts said first protuberance first.

3. The method according to claim 1, wherein said forming tool is moved in a direction of said revolution center line.

4. The method according to claim 3, wherein said step of moving said forming tool includes reciprocating said forming tool in a direction of said revolution center line a plurality of times.

5. The method according to claim 4, wherein said step of press contacting includes moving said forming tool by a predetermined distance towards said revolution center line side so that said revolution radius is reduced at least at one end portion in a direction of the reciprocal movements.

6. The method according to claim 2, wherein said forming tool is moved in a direction of laid revolution center line.

7. The method according to claim 6, wherein said step of moving said forming tool includes reciprocating said forming tool in a direction of said revolution center line a plurality of times.

* * * * *

UNITED STATES PATENT AND TRADEMARK OFFICE

CERTIFICATE OF CORRECTION

PATENT NO. : 6,637,248 B2
DATED : October 28, 2003
INVENTOR(S) : Ishii et al.

It is certified that error appears in the above-identified patent and that said Letters Patent is hereby corrected as shown below:

Column 6,
Line 34, claim 3, should read as follows:
3. The method according to claim 2, including an additional step of moving said forming tool in a direction of said revolution center line.
Line 45, claim 6, should read as follows:
6. The method according to claim 1, including an additional step of moving said forming tool in a direction of said revolution center line.

Signed and Sealed this

Eleventh Day of May, 2004

JON W. DUDAS
*Acting Director of the United States Patent and Trademark Office*